United States Patent [19]

Simmons

[11] 4,177,927

[45] Dec. 11, 1979

[54] APPARATUS FOR SHAPING AND POSITIONING FLUID DISPERSAL PATTERNS

[76] Inventor: Thomas R. Simmons, 3510 Lobit, Dickinson, Tex. 77027

[21] Appl. No.: 860,394

[22] Filed: Dec. 14, 1977

[51] Int. Cl.[2] ..... B05B 1/08; A47K 3/00; A47K 3/22

[52] U.S. Cl. ..... 239/101; 4/145; 134/172; 239/421; 239/543

[58] Field of Search ..... 4/145–147, 4/152, 172.15, 172, 172.17, 180; 239/66, 101, 421, 545, 102, 543, ; 128/66; 137/602, 607; 134/172, 198

[56] References Cited

U.S. PATENT DOCUMENTS

| | | | |
|---|---|---|---|
| 605,868 | 6/1898 | Grimm | 239/421 X |
| 2,739,844 | 3/1956 | Wilson | 239/421 |
| 3,365,137 | 1/1968 | Corsette | 239/543 X |
| 3,507,275 | 4/1970 | Walker | 128/66 X |
| 3,680,783 | 8/1972 | Springer | 239/101 |
| 3,971,074 | 7/1976 | Yxfeldt | 4/145 |
| 4,002,293 | 1/1977 | Simmons | 239/545 |
| 4,052,002 | 10/1977 | Stouffer | 239/101 X |

FOREIGN PATENT DOCUMENTS

| | | | |
|---|---|---|---|
| 942676 | 2/1974 | Canada | 239/102 |
| 2140526 | 2/1973 | Fed. Rep. of Germany | 239/102 |

*Primary Examiner*—Stuart S. Levy
*Attorney, Agent, or Firm*—Bard & Groves

[57] ABSTRACT

Apparatus is provided for use in a residential shower stall and the like, wherein one or more sets of projected fluid streams are collided against the human body in dispersals having preselected shapes and movement or location functionally related to the height of the occupant in order to scour and cleanse the body of the bather. In an alternate embodiment, a system operating from city water pressure alone provides for a flip-flop spray pattern from a plurality of nozzles releasably attached to various points on the wall of the shower stall or the like.

4 Claims, 10 Drawing Figures

FIG. 2
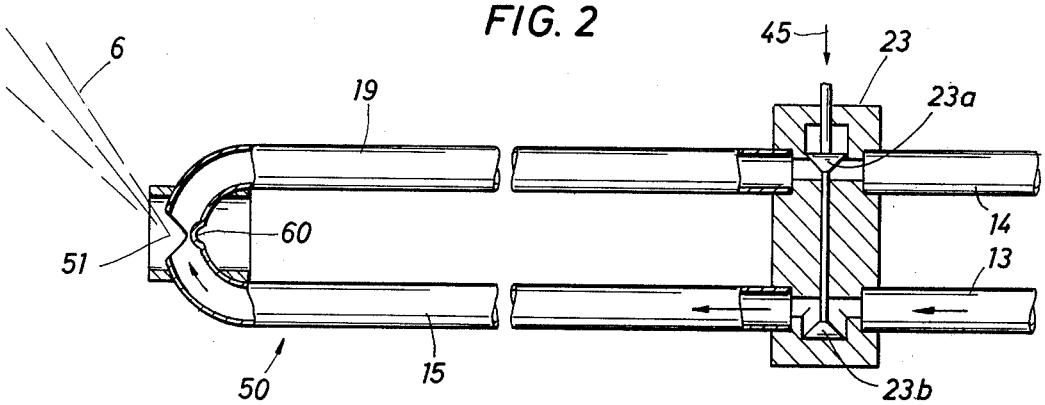
FIG. 3
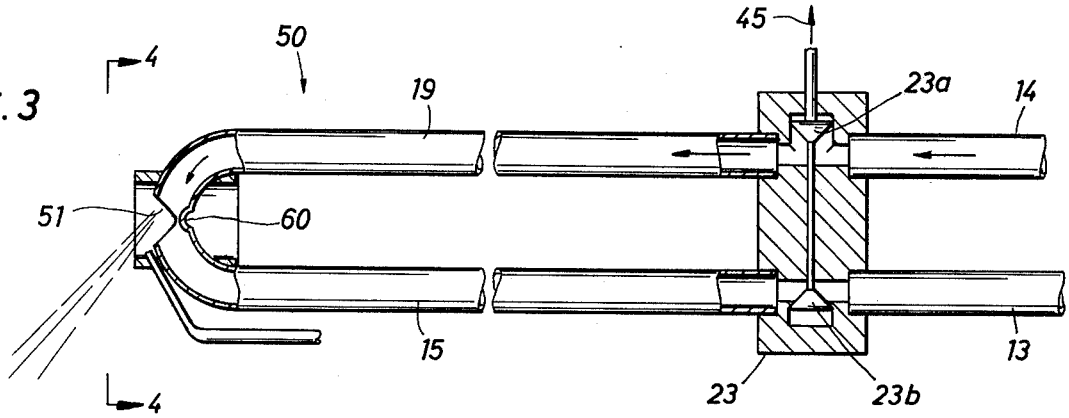
FIG. 4
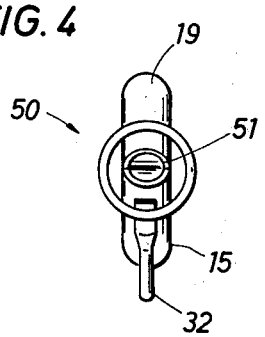
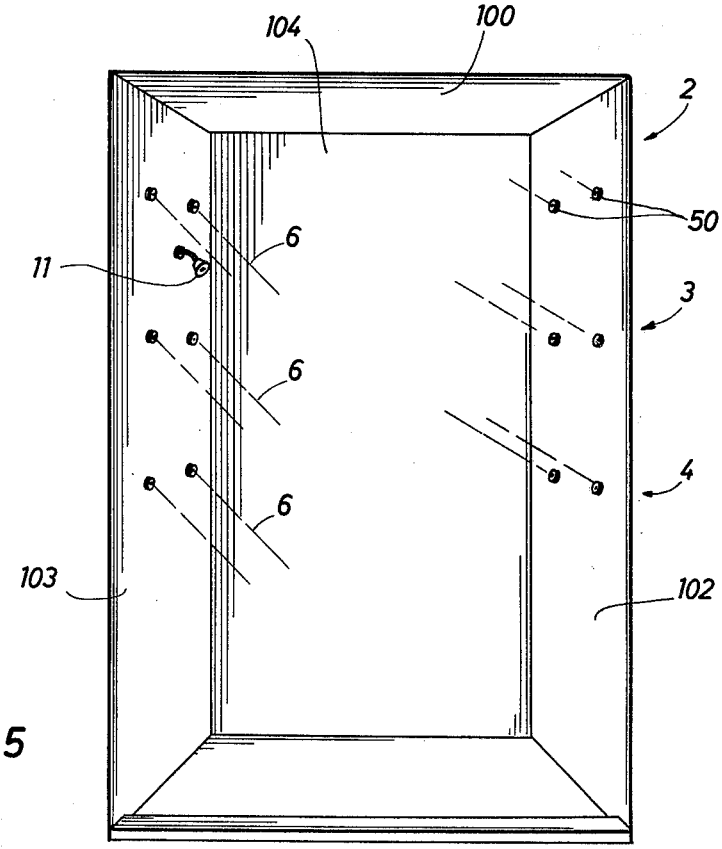
FIG. 5

APPARATUS FOR SHAPING AND POSITIONING FLUID DISPERSAL PATTERNS

BACKGROUND OF INVENTION

This invention relates to an improvement over apparatus of my prior U.S. Pat. No. 4,002,293, and more specifically to apparatus for producing and manipulating liquid sprays of various configurations. More particularly, this invention relates to apparatus for producing and manipulating such sprays for utilitarian purposes. Specifically, means are provided for use in a residential or commercial shower stall wherein one or more sets of liquid sprays of fan-like configuration are produced and manipulated in an unusual and spectacular flip-flop manner.

It is well known that the presence of a bathtub or shower stall usually tends to have a distinct beneficial effect on the occupants of any residence. Insofar as humansare concerned, the greater benefit is often largely psychological in character, and thus combination bathtub-showers are commonly constructed and enjoyed in commercial and private residential areas. These showers are of many different types and designs and employ pressure flows from a single shower head.

Accordingly, showers have been designed and built wherein pressured water streams are arranged in various geometric patterns from a single source and are directed in various changeable directions. In addition, the single source sprays may be formed in the manner of cones, generally by the use of a single nozzle of suitabale well known construction and configuration. Also, the occurrence of such shower sprays may be varied in both a regular as well as a random manner by interrupting the flow of the stream, or by appropriate manipulation of the single shower-type spray nozzle conventionally found in single family dwellings and commercial establishments such as hotels and motels.

SUMMARY OF INVENTION

In the present invention, however, novel apparatus is provided wherein a plurality of traveling streams or jets of water or the like are projected into collision with the occupant of the shower according to a preselected configuration. If the nozzles are of equal cross-sectional size and pressure, and if they are directed along the same path, the dispersal pattern will be fan-like in shape and will move substantially perpendicular to the human occupant in the shower. Furthermore, the points of collision will be substantially from head to foot and then back again.

If the pressure of one of the two feed streams is greater than the other, then the flow will be in an upward direction. Pressure reversal will cause downward flow from the nozzle although the dispersal pattern will nevertheless be fan-shaped and perpendicular to the bather. Thus, the dispersed stream may be caused to move up and down and between the head and feet of the bather by selectively varying the pressures on the two feed streams.

It should be noted that the shape of the dispersal pattern depends on the relative cross sections of the nozzles forming the streams, whereas the location of the dispersal between head and foot of the bather depends upon a timed differential between plural sets of nozzles. It should further be noted, however, that as used herein the term "pressure" really means the velocity of the water or fluid after it is ejected from a nozzle or port to form a free traveling fan-shaped stream traveling in midair.

The path of the streams may be horizontal or vertical, or even tilted at an angle with respect to the earth, provided they are ejected under pressures great enough to negate the force of gravity. Accordingly, streams may be arranged in a variety of configurations, and controlled according to a variety of programs, to provide a variety of interesting sprays and spray patterns.

As hereinbefore stated, the apparatus of the present invention is applied to utilitarian purposes. In particular, a shower apparatus may be provided wherein streams collide with the bather at locations such that dispersal occurs adjacent all surfaces of the body to be cleansed and rinsed. In addition, pressure may be varied to travel the dispersal patterns up and down and across such body surfaces to enhance their cleansing and scouring effect, and the relative position of the streams may be varied to direct dispersals into less accessible portions of the shower stall than has been known heretofore.

It is an essential feature of this invention that the liquid streams which produce the desired dispersal pattern be fan-shaped. If the streams have such a configuration, their collision with the bather will produce patterns which do not tend to break apart except at their perimeters, where the force of gravity begins to exceed the force of the stream. Many types of nozzles or other ejections means can be used for producing suitably formed streams, such as a simple section of pipe or tubing or the like.

In the present invention, the streams of liquid are discharged in a fan-shaped or substantially fan-shaped configuration from the nozzles to their point of collision with the bather. If the streams are kept free of an appreciable amount of air or other gas, the result will be a fan-like dispersal of liquid which will also be substantially "solid" or non-aerated, except at its perimeter where the effect of gravity will cause the liquid at the edge of the dispersion to separate and fall away in the forms of droplets.

These and other features and advantages of the present invention will become apparent from the following detailed description, wherein reference is made to the accompanying drarwings.

IN THE DRAWINGS

FIG. 2 is a simplified functional representation of another view of a single nozzle with the dispersal pattern illustrated in FIG. 1 and depicting its upward spray disposition.

FIG. 3 is another simplified functional representation of the streams depicted in FIG. 1, wherein one stream has a greater pressure than the pressure of the other stream, and accordingly a downward flow results.

FIG. 4 is a front view of the nozzle taken along line 4—4 of FIG. 3.

FIG. 5 is a further simplified functional representation of the streams depicted in FIGS. 1–3 but wherein the arrangement is embodied in a conventional residential shower stall.

DETAILED DESCRIPTION

Figure 1:
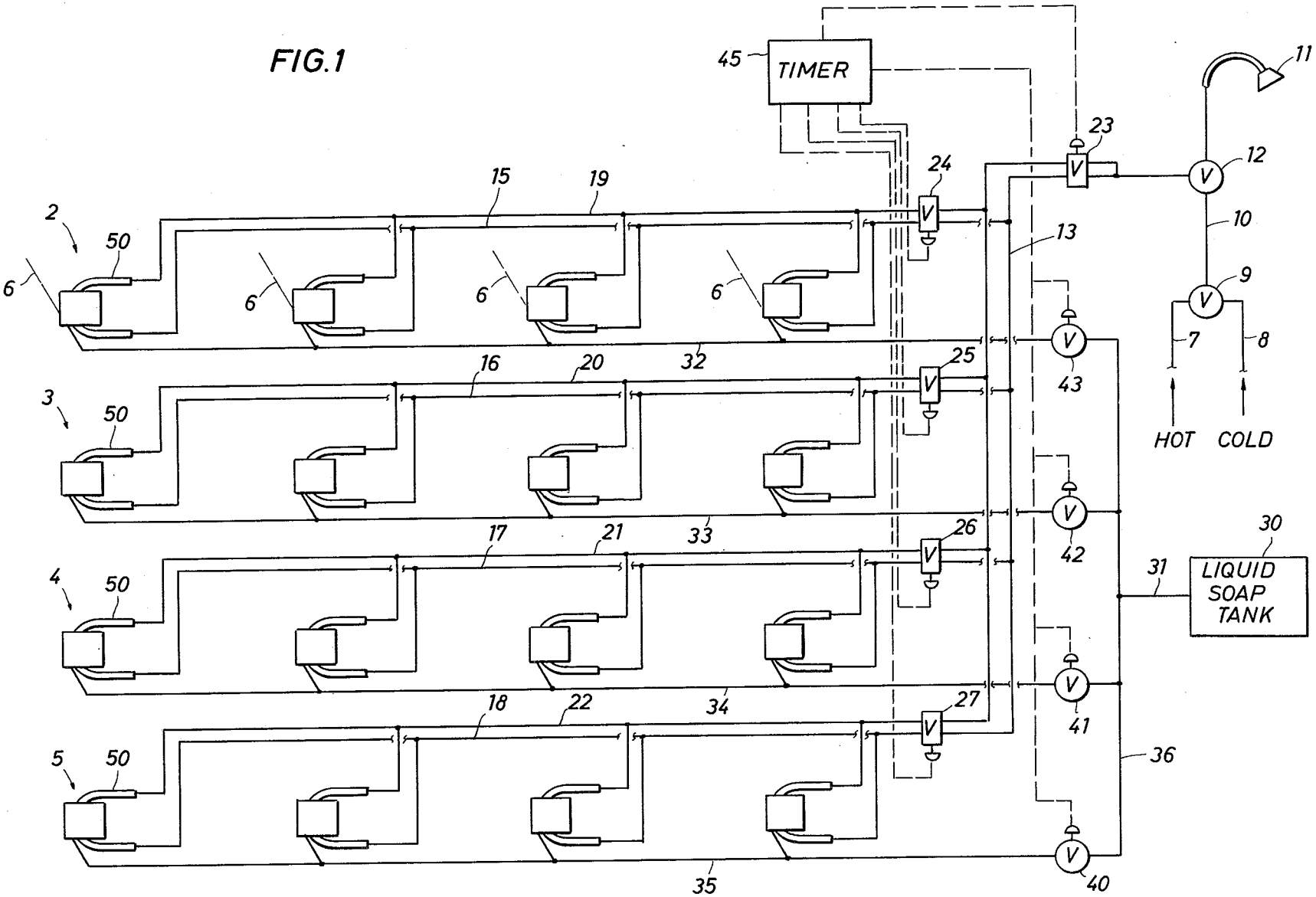
FIG. 1 is a simplified functional representation of an embodiment of the present invention as exemplified by four sets of projected free traveling fluid streams of substantial magnitude directed to form a fan-like pattern of dispersal.

Referring now to FIG. 1, there may be seen a simplified functional representation of basic apparatus employing the concept of the present invention, such apparatus including a first discharge means or nozzle bank 2 preferably having the form of a tube and arranged in vertically spaced relationship to a second, third and fourth discharge means or nozzle banks 3, 4 and 5, preferably of the same type. More particularly, it may be seen that nozzle bank 2 delivers four pressure streams of water 6 in an upwardly directed fashion. Located below nozzle bank 2 is arranged the other three nozzle banks 3–5 each adapted to provide four more fluid streams similar to streams 6 above noted. While four banks of nozzles each adapted to spray four streams are shown, this is merely exemplary of the invention as other numbers of banks of other numbers of nozzles could be provided without departing from the essential concepts disclosed herein.

As more specifically shown in FIG. 1, city water is provided at lines 7 and 8 passed through a blending valve 9 of the type for varying the temperature of the water ultimately issuing from the nozzles. Warm water from valve 9 passes through conduit 10 and is diverted from the conventional shower head 11 by valve 12 into the system of the present invention.

More particularly, first and second manifold flow lines 13 and 14 are provided to split the warm water stream issuing from valve 12. Line 13 delivers a first portion of the warm water stream to a first lower set of four nozzle feed conduits 15, 16, 17 and 18. In a similar fashion, line 14 delivers a portion of warm water stream to a second set of four upper nozzle feed conduits 19, 20, 21 and 22. Thus, it should be apparent that by proper manipulation of the pulsating solenoid valve 23, warm water may be selectively and alternately passed to either the lower bank feed line 13 or to the upper bank feed line 14.

A further series of four solenoid valves 24, 25, 26 and 27 are shown disposed one in each of the nozzle banks 2–5, with each solenoid including means such as 24*a* and 24*b* to alternately stop and start fluid flow in lower feed bank 15 as well as upper feed bank 19. As shown in FIG. 1, only lines 15 and 19 are open to flow therein. Valves 25, 26 and 27 are otherwise closed thereby blocking flow to lines 16–18 and 20–22.

A suitable gravity feed liquid soap tank 30 is provided as seen in FIG. 1, and appropriate piping 31–36 is provided to deliver soap to each of the sixteen nozzles. Again, solenoid type valves 40, 41, 42 and 43 may be provided to control the wash soap flow to each bank of nozzles 2–5.

A conventional timer 45 is provided to actuate and deactuate the various valves at various predetermined time intervals and sequences. In a preferred embodiment of the present invention, valve 23 is timed to be actuated every 0.5 seconds, while valves 24, 25, 26 and 27 are actuated one every 2.0 seconds. With such a system, and as hereinafter explained in detail, the spray in bank 2 will flip-flop four times and then shift to bank 3. In bank 3, the spray will flip-flop four times as seen in FIGS. 2 and 3, and then in two seconds move to bank 4. Four flip-flop sprays in bank 4 will terminate in two seconds wherein the sprays will shift to bank 5 and then return to bank 2 to begin the sequence anew.

The sequence of operation should become more apparent from the simplified showing of a single nozzle and the alternate spray produced as a result of pulsating the feed lines. Thus, in FIG. 2, there may be seen one of the nozzles of bank 2, for example. The nozzle is constructed of a U-shaped tube 50 having a wedge shaped aperture at 51, which appears as a sector of a circle as seen in FIG. 4, to provide the spray exit 6. Each spray nozzle 50 includes first and second feed lines 15 and 19 for delivering water to the nozzle aperture 51 to be dispersed therefrom. As seen more particularly in FIG. 2, solenoid 23 is actuated by timer 45 every half-second to alternately open and close lines 15 and 19. Thus, with line 19 closed as in FIG. 2, water will flow through line 15 and out aperture 51 in an upward direction as shown. This will continue for one-half second whereupon timer 45 actuates solenoid valve 23 again to close line 15 and to open line 19 as seen in FIG. 3. In this position, there is no substantial flow in line 15 but flow in line 19 is opened whereby water under pressure issues from aperture 51 in a downward direction as illustrated.

It should be apparent, that depending upon the sequence at which the timer 45 is set, one may obtain the up and down or flip-flop type of the flow pattern shown in FIGS. 2 and 3. As noted above, flip-flops at half-second intervals have been found to be convenient for most purposes. Thus, taking FIG. 1 in conjunction with both of FIGS. 2 and 3, it will be seen that the sequence of operation will proceed as follows: Water will flow through bank 2 nozzles for two seconds before timer 45 shuts valve 24 and opens valve 25. During this first two-second interval, valves 25, 26 and 27 are closed and only valve 24 is open. With valve 23 continuously pulsing at half-second intervals, it will be apparent that water will flow alternately each half-second into lines 15 and 19. Flow in line 15 causes each nozzle in bank 2 to direct upward streams as seen in FIG. 2. at the end of that half-second, water will flow in line 19 only to cause a downward spray as seen in FIG. 3. This sequence will repeat again, and at the end of two seconds, four stream directional changes will have occurred before valve 24 is closed and the spray pattern is moved to bank 3.

It should be apparent that for each two seconds of water supply to bank 2, there is caused four flip-flops or spray direction changes as seen in FIGS. 2 and 3. This half-second shifting of spray direction produces more or less of a fanning action of the water, and as timer sequentially opens and closes valves 24–27, it will be seen that the flip-flop fanning action in bank 2 moves progressively into each of banks 3–5 every two seconds before it again returns to bank 2. During the time that timer 45 causes valves 24–27 to actuate to move the flow from bank to bank, pulsator valve 23 continues to alternately open and close lines 13 and 14 each half-second in order to provide the flow directional changes shown in FIGS. 2 and 3. Flow deflector means 60 formed as a crimp in nozzle 50, as seen in FIG. 4, assists in directing the flow of fluid in lines 15 and 19 in the indicated path of travel.

With reference now to FIG. 5, there will be seen a structure 100 for bathing and typically referred to as a shower stall. The stall, as is well known, includes a drain sump for conveying away accumulated liquid laden with detergent. A passageway is provided to permit ingress and egress and such passageway is typically provided with a plastic shower curtain to prevent the shower sprays from reaching the outside floor surface of the stall. The enclosure or stall as will be seen in FIG. 5 constitutes a plurality of upstanding sidewalls 102, 103 and 104 normally constructed of fiberglass but in many cases of tiled-constructed where the tub and shower are not of unitary construction.

It is a feature of the embodiment of FIG. 5 to adapt the spray system of FIG. 1 into the conventional stall and this is accomplished by mounting the various banks 2–5 of nozzles into the sidewalls 102 and 103, as clearly illustrated. Thus, each nozzle is mounted flush to a sidewall so as not to interfere with the flip-flop fanning action of the numerous sprays as they are cycled at half-second intervals, and moved from bank to bank every two seconds. It should be apparent that any desired number of nozzle banks may be mounted in any number of sidewalls, and in other configurations or locations than as shown in FIG. 5. FIG. 5 is merely an exemplary embodiment for the purpose of illustrating the concept of the present invention.

In summary then, it is to be noted that the present invention provides a novel fluid dispersal system wherein at least one bank of a plurality of nozzles are cycled at half-second intervals in alternate up and down stream directions to produce spray patterns of water which act in the fashion of a fan. In the preferable embodiment, the fanning streams of fluid are caused to be moved from bank to bank at two-second intervals. This moving fan-like arrangement will be understood to follow the body of the bather from head to foot, and to return to the head for another cycle. The result of the moving fan of water, when in conjunction with the gravity fed soap solution, is that the body of the bather is thoroughly scoured and cleansed with little or no requirement of assistance from the bather. This is of particular importance in the case of cripples and invalids who have been caused to be unable to bathe or shower themselves. All that is required is that the bather position himself or herself in the shower and in the path of travel of the moving fans of water.

The present invention is also considered beneficial in that the shower may be suitably adjusted to suit the height of the bather. Thus, in the case of small children, one or more of the upper banks 2–3 of nozzles may be cycled out and only one or more of the lower nozzle banks 3–4 used for cleansing. Appropriate and conventional controls may be provided for this, as in the case of the timer illustrated generally at 45 which may comprise a known motor driven shaft, for example, turning a plurality of conventional cams each of which is arranged to actuate and deactuate spring loaded switching devices.

In the case of the pulsating valve 23 and control valves 24–27, there may be provided flexible tubing 15–22 together with solenoid actuated means to alternately pinch off the various lines to effect either the pulsating action of valve 23 or the on-off flow control function of valves 24–27.

While the pulsator valve 23 has been noted to pulse at half-second intervals, obviously other pulse speeds may be selected depending of course on the particular rapidity desired in the stream fanning action in a particular nozzle bank. Similarly, movement of the fan spray from bank to bank may be timed at other than the referred to two-second intervals. Such timing would be dependent upon the speed desired to cover the body from head to foot during each cycle increment.

It is believed that the provision of the disclosed spray pattern of moving fans of water will not only be beneficial from the standpoint of cleansing the body of the bather but will also provide an inducement to humans, such as children, to bathe due to the unique water pattern provided. It is believed that the chore of bathing, with the present invention, will be an item of daily enjoyment rather than a mere ardous task.

The cross-sectional shape of the streams 6 is substantially immaterial to the concept of the present invention. As indicated in FIG. 2, the streams 6 may be circular or fan-shaped in cross-sectional configuration, but they may also be of some other shape as may be desired for some other reason.

Although the utility of the present invention has been heretofore discussed principally with respect to a shower stall, it should be understood that the term "stall" covers any means for discharging a spurt or jet of water or other fluid, and that the present invention will therefore have many useful applications. Thus, the concepts disclosed herein could be supplied to an automatic dishwasher. More particularly, it will be understood that the interior chamber of an otherwise conventional dishwasher may be provided with racks for holding a plurality of nozzles 2–5, and that such nozzles may be provided for the purpose of projecting pressured streams 6 in between the dishes. Means such as hereinbefore discussed may be included in such an arrangement for the purpose of traveling the dispersals 6 backwards and forwards across the various surfaces of the dishes for the purpose of enhancing the scouring effect achievable with the dispersals. In addition, other means may be provided for imparting different configurations to the dispersals as hereinbefore discussed in detail.

It will readily be apparent that various modifications and alterations may be employed. For example, the sprays of FIG. 1 may be embodied in indoor or outdoor display fountains and decorative effect is obtainable with apparatus such as depicted herein and may be enhanced by the use of streams of different types or colors of fluids, and the dancing effect achieved by moving the different dispersals may be accompanied by music or by moving light displays. Similarly, dishes may be washed as well as rinsed by providing alternate streams of detergent as well as rinse water. In addition, it is noted that the structure of FIG. 2, for example, could take the form of a pair of separate and distinct pipes, one directed upwardly and one directed downwardly, and with flow control means for each pipe, rather than the single curved tube as illustrated.

Figure 6:
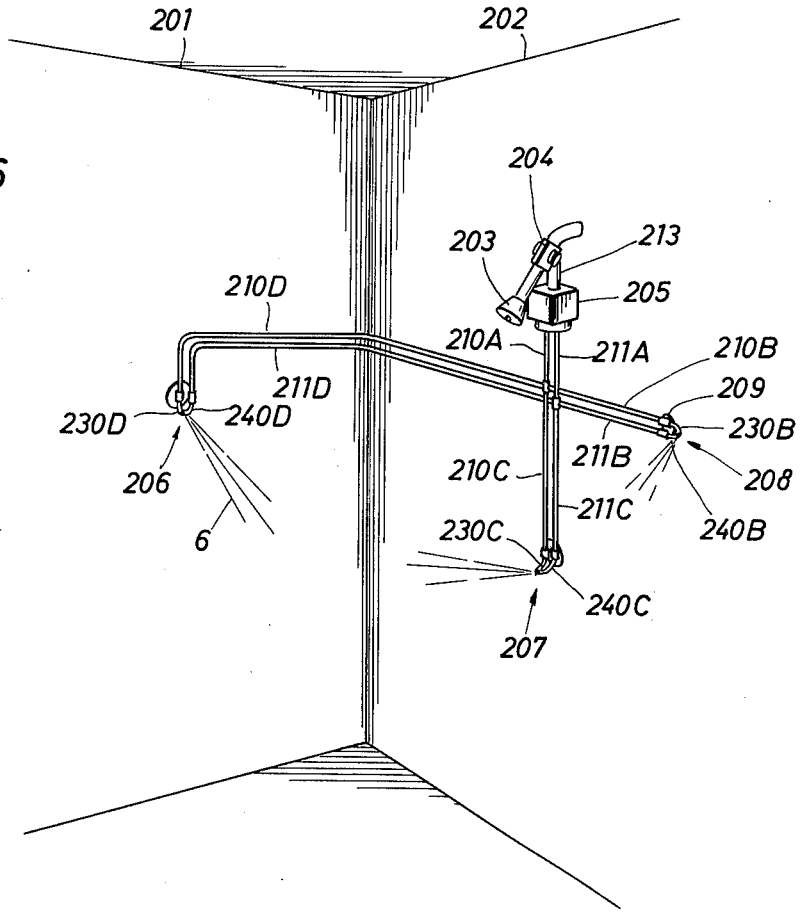
FIG. 6 is a representation of an alternate embodiment of the present invention and wherein three nozzles are releasably attached to the shower wall and actuated by city water pressure alone.

Referring now to FIG. 6, there is shown an alternate embodiment of the invention of simpler function and construction. In this embodiment the flip-flop made of the nozzles is accomplished in a purely mechanical fashion and without the necessity of the electrical systems of the embodiment of FIGS. 1–5.

More particularly, there is seen in FIG. 6 a shower stall including walls 201 and 202. A conventional shower head 203 extends through wall 202 and is bypassed by a diverter valve 204. Valve 204 causes city water to pass into gear converter unit 205 rather than to pass through shower head 203. Obviously, proper manipulation of valve 204 can render the shower head 203 operative when it is not desired to use the flip-flop nozzle system of this embodiment.

Three nozzles, 206, 207 and 208 of construction similar to that of FIGS. 2–4, are mounted to removable suction cups 209 to releasably attach the nozzles at any desired location and disposition within the shower stall walls. These nozzles function as hereinbefore described except that the stream from each nozzle may be caused to flip-flop in any desired plane depending upon the disposition of the nozzle apertured. Thus, vertical, left to right, or angular flip-flop spray patterns may be produced.

As seen in FIG. 6, each nozzle may be fed by two separate streams of water from converter 205. A first flow of water is directed to the upper tubes of each nozzle by means of flexible conduits 210A, 210B, 210C and 210D. On the other hand, the lower tubes of each nozzle are fed by a second stream of water via flexible conduits 211A, 211B, 211C and 211D. As the flow of water is cycled at intervals between lines 210A and 211A it will be apparent that the flip-flop flow from each nozzle as shown generally in FIGS. 2 and 3 will be produced. Such interval of flow between lines 210A and 211A is produced as will be pointed out hereinafter by the converter 205 shown in more detail in FIGS. 7–10.

Figure 7:
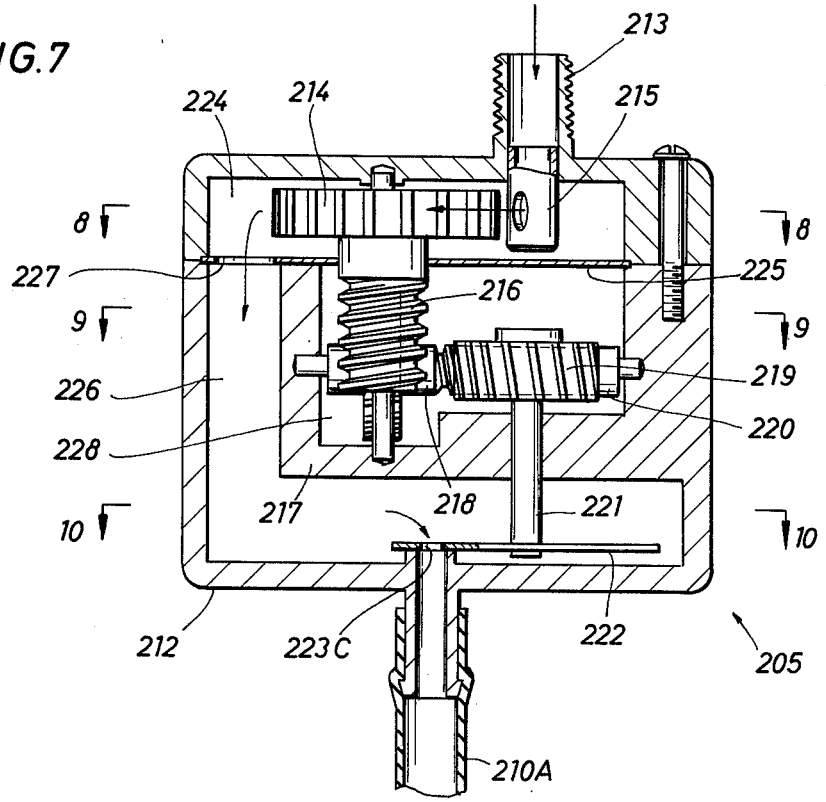
FIG. 7 is a detailed view of the gearing mechanism used in the embodiment of FIG. 6 for converting city water pressure into mechanical movement in order to actuate the nozzles.
Figure 8:
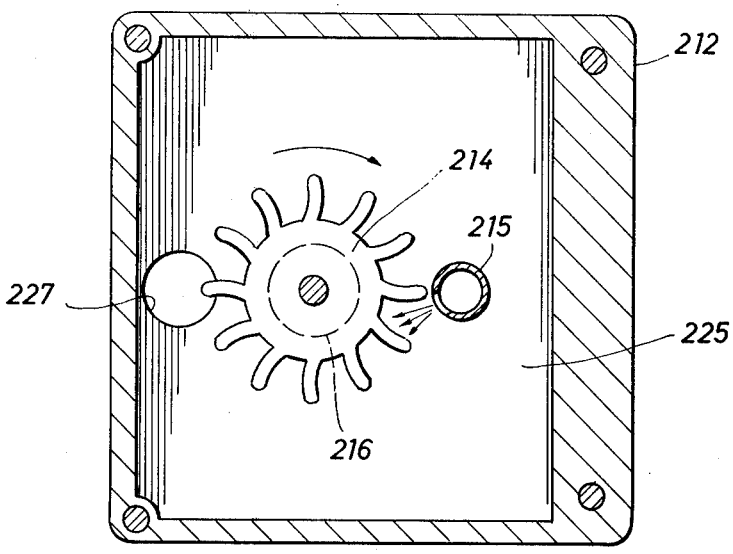
FIGS. 8–10 are further detailed views of the gear system converter of FIG. 7 and taken along lines 8—8 to 10—10 of FIG. 7.
Figure 9:
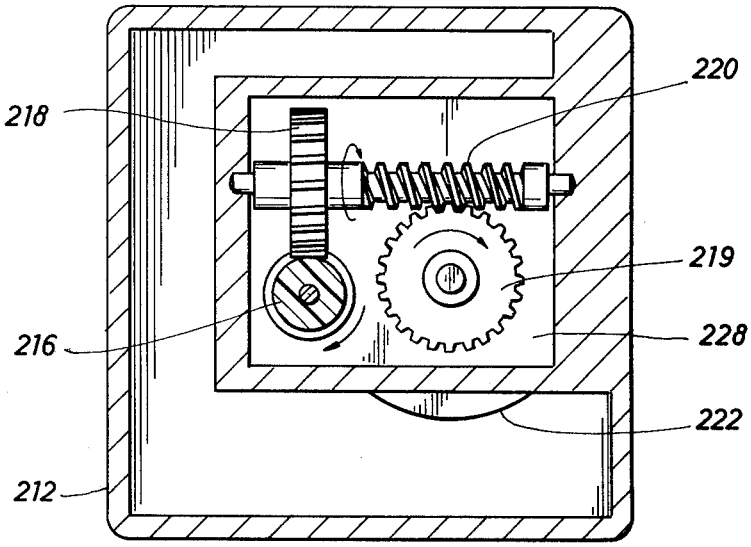

Thus, referring now to FIG. 7, converter 205 consists of a closed housing 212 fed by flow lines 213. City water under pressure enters through line 213 where it is diverted against impeller 214 by apertured plug 215. Impeller 214 has integrally attached thereto gear 216 journaled in housing wall 217. Gear 216 is meshed with gear 218 which drives gear 219 via surface 220. Thus, it will be seen that the movement of water at conduit 213 drives impeller 214, which transmits rotational movement to shaft 221 via gears 216, 218, 220 and 219. More particularly, the gearing mechanism within converter 205 converts the movement of water across impeller 214 into a resultant rotational movement of shaft 221.

Figure 10:
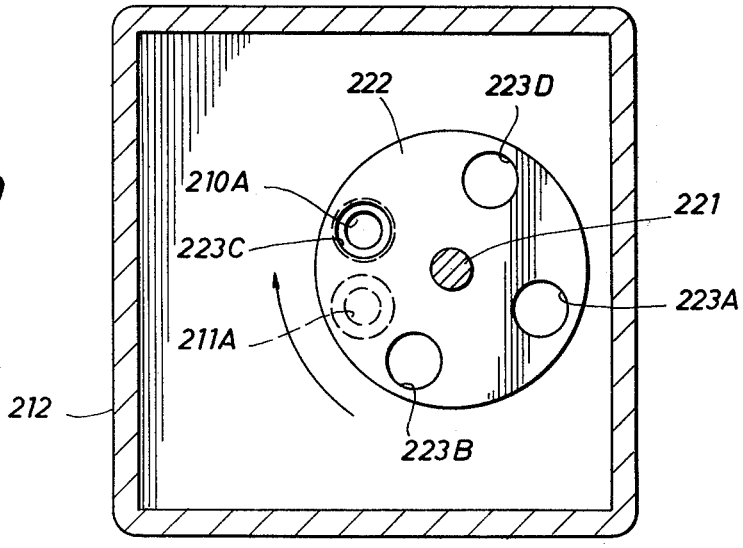

As shown more particularly in FIG. 10, shaft 221 has attached thereto a circular disk 222 at a predetermined speed of movement and thereby alternately bring each of apertures 223 A–D into and out of communication with outlets 210A and 211A. FIG. 10 for example shows aperture 223C in open communication with one of the nozzle feed lines 210A.

It should be apparent that the apertured rotating disk 222 in operation functions in the nature of a single valve to open and close flow to each of lines 210A and 211A. As illustrated in FIG. 10, flow of water through line 210A is provided whereas flow through line 211A is blocked as illustrated in dotted lines. As disk 222 continues to rotate as seen in FIG. 10, aperture 223B will open flow to line 211A whereas flow to line 210A will be blocked. This alternate opening and closing of flow to lines 210A and 211A by disk 222 can be set at any predetermined time interval sequence by varying the number of apertures in the disk 222 or by varying the spacing between particular apertures. Obviously, disk 222 could be constructed with only a single aperture therein to alternately open and close flow to lines 210A and 211A.

Referring again to FIG. 7, impeller 214 is isolated in chamber 224 by a partition wall 225. Communication between chamber 224 and 226 is provided by aperture 227 in partition 225. Since gears 216, 218, 219 and 220 are isolated in gear compartment 228 by partition 225 and the interior housing wall 217, the flow of water follows a path from inlet 213, into chamber 224, through aperture 227, into chamber 226, and out one of lines 210A and 211A depending upon the alignment of apertures 223 A–D.

As hereinabove explained, flow of water across impeller 214 is converted to rotational motion of disk 222 by the gear mechanmism in compartment 228. The disk 222 functions as a valve to alternately feed lines 210A and 211A, and thereby there is provided a purely mechanical system to effect flip-flop of the nozzle spray patterns. As shown in FIG. 7, water will enter line 210A and be transmitted via conduits 210B, C and D, to the upper tubes 230B, C and D. This will direct flow from nozzles 206, 207 and 208, in a first direction. As disk 222 continues to rotate, flow to conduit 210A will cease and flow to conduit 211A will commence. This will direct water to conduits 211B, C and D, and in turn to the lower tubes 240B, C and D. Such flow in tubes 240B, C and D will direct water in nozzles 206, 207 and 208, in a second direction opposite that above described. Continued rotation of disk 222 will again communicate flow to line 210A and the cycle will be repeated, such cyclic repetition functioning to produce alternately directed flows from the nozzles as illustrated in more detail in FIGS. 2 and 3.

It will be apparent from the foregoing that many other variations and modifications may be made in the structures and methods described herein without substantially departing from the essential concept of the present invention. Accordingly, it should be clearly understood that the forms of the invention described herein and depicted in the accompanying drawings are exemplary only and are not intended as limitations in the scope of the present invention.

What is claimed is:

1. A fluid dispersal system for discharging an oscillating fan-like stream of liquid, comprising a pair of conduits aligned in a plane and interconnected to receive and carry a flow of liquid, nozzle means interconnected with said conduits for discharging said liquid as a fan-like stream positioned substantially perpendicular to said plane, said nozzle means includes a deflector means therein for forming said fan-like stream, said control means causes the stream to sweep between preselected limits of oscillating travel with said plane, said nozzle means further comprises a tubular conduit member formed into a substantially U-shaped configuration including a pair of legs lying in the same plane and joined by an arcuate portion, said arcuate portion having first and second exterior surfaces spaced opposite one another, an aperture in said first surface of substantially wedge shape when viewed in a direction perpendicular to said plane and of a shape substantially that of a sector of a circle when viewed in a direction parallel to said plane, said deflector means being formed by said second surface having a crimp therein extending substantially perpendicular to said plane, and control means interconnected with said conduits for oscillating said fan-like stream in parallel alignment with said plane and at a predetermined rate of approximately 0.5 seconds.

2. The system of claim 1 wherein said control means comprises a reciprocal valve member.

3. The system of claim 1 wherein said control means comprises a movable valve member.

4. The system of claim 3 wherein said control means comprises a rotatable valve member.

* * * * *